US005171357A

United States Patent [19]

Aguirre et al.

[11] Patent Number: 5,171,357

[45] Date of Patent: Dec. 15, 1992

[54] VACUUM PROCESSING OF PARTICULATE REACTIVE METAL

[75] Inventors: Carlos E. Aguirre, Downingtown; Howard R. Harker, Malvern, both of Pa.

[73] Assignee: Axel Johnson Metals, Inc., Lionville, Pa.

[21] Appl. No.: 808,004

[22] Filed: Dec. 16, 1991

[51] Int. Cl.[5] ..... C22B 4/00

[52] U.S. Cl. ..... 75/10.19; 75/640; 75/645; 266/168

[58] Field of Search ..... 75/10.19

[56] References Cited

U.S. PATENT DOCUMENTS 2,734,244 2/1956 Herres ..... 75/10.65
3,101,515 8/1963 Hanks ..... 164/506
3,771,585 11/1973 Ulrich ..... 75/10.19
4,571,259 2/1986 Fey ..... 75/10.19

*Primary Examiner*—Peter D. Rosenberg
*Attorney, Agent, or Firm*—Brumbaugh, Graves, Donohue & Raymond

[57] ABSTRACT

In the particular embodiments described in the specification, a vacuum furnace includes a hearth having a melting region and a refining region and a particulate metal supply tube for conveying particulate metal to one side of the melting region. Three water-cooled shield members surround the other sides of the melting region so that metal ejected from the particulate metal deposited in the melting region by explosive vaporization of inclusions in the metal is intercepted by the shield members.

10 Claims, 1 Drawing Sheet

VACUUM PROCESSING OF PARTICULATE REACTIVE METAL

BACKGROUND OF THE INVENTION

This invention relates to improvements in vacuum processing of particulate reactive metal, such as in an electron beam or plasma furnace, and to an improved furnace for use in such processing.

Certain reactive metals such as titanium, for example, are prepared by reduction of chlorides of the metals using sodium or magnesium to produce sponge metal. Such sponge metals, however, contain trapped sodium or magnesium chloride and, when heated in a vacuum such as in an electron beam or plasma furnace, the trapped chlorides vaporize in an explosive manner, spraying unmelted sponge particles throughout the interior of the furnace so as to reduce the yield and also contaminate material which has been refined in the furnace with unrefined particles. Similarly, scrap material resulting from the machining or other forming of such metals which has been compacted into a solid piece for processing may contain vaporizable impurities which produce the same effect.

One way of avoiding this problem is to use an inert gas plasma burner which operates at higher pressures, as described in the Ulrich U.S. Pat. No. 3,771,585, but this does not provide the advantages of an electron beam or plasma furnace operated at high vacuum. The Hanks U.S. Pat. No. 3,101,515 discloses an electron beam furnace with magnetically guided beams in order to avoid contamination of the electron beam source by sponge particles explosively ejected from the raw material, but that arrangement does not avoid the problem of lost material and contamination of the refined material. The Herres U.S. Pat. No. 2,734,244 discloses a vacuum arc refining furnace for titanium sponge which requires a separate chamber to vaporize and drive off volatile inclusions from the sponge material which might interfere with the refining process, after which the material is delivered to the refining furnace.

In the copending Harker application Ser. No. 07/555,913, filed Jul. 19, 1990, such particulate material is compacted into bars which are conveyed toward the melting area of a hearth with end faces in opposed relation so as to intercept particles ejected from an opposing face and thereby block such material from reaching other parts of the vacuum furnace. That arrangement, however, not only necessitates compaction of particulate material into bar form, but also requires a complex and expensive bar-conveying system.

SUMMARY OF THE INVENTION

Accordingly, it is an object of the present invention to provide a new and improved process for vacuum refining particulate reactive metal which overcomes the above-mentioned disadvantages of the prior art.

Another object of the invention is to provide a vacuum furnace for processing particulate reactive metals in an improved manner.

These and other objects of the invention are attained by supplying particulate metal to be processed to the melting region of a vacuum furnace and providing one or more sprayintercepting shield members substantially enclosing the melting region to block unmelted material sprayed from the heated surface of the metal member from reaching other parts of the vacuum furnace. In one embodiment, particulate reactive metal is conveyed to the melting region through a conveyor at one side of the melting region and closely-spaced water-cooled shield members surround the other sides of the melting region to intercept material sprayed from the melting region by splashing during introduction of particles into the melting region or by spraying from the surface of the particulate material as it is heated.

In a typical vacuum furnace arranged for processing metal according to the invention, a particulate metal feeding tube supplies particulate metal to one side of the melting area of the hearth and three water-cooled shield members are supported on the other sides of the melting area with their bottom edges disposed in closely-spaced relation to the surface of the molten material in the hearth and an energy source positioned above the region surrounded by the feeding tube and the shield members supplies energy to melt the particulate metal supplied from the feeding tube. As a result, substantially all of the solid metal particles sprayed from the heated particulate material by vaporized inclusions is intercepted by a shield and is deposited on the shield surface or falls back into the melting area.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
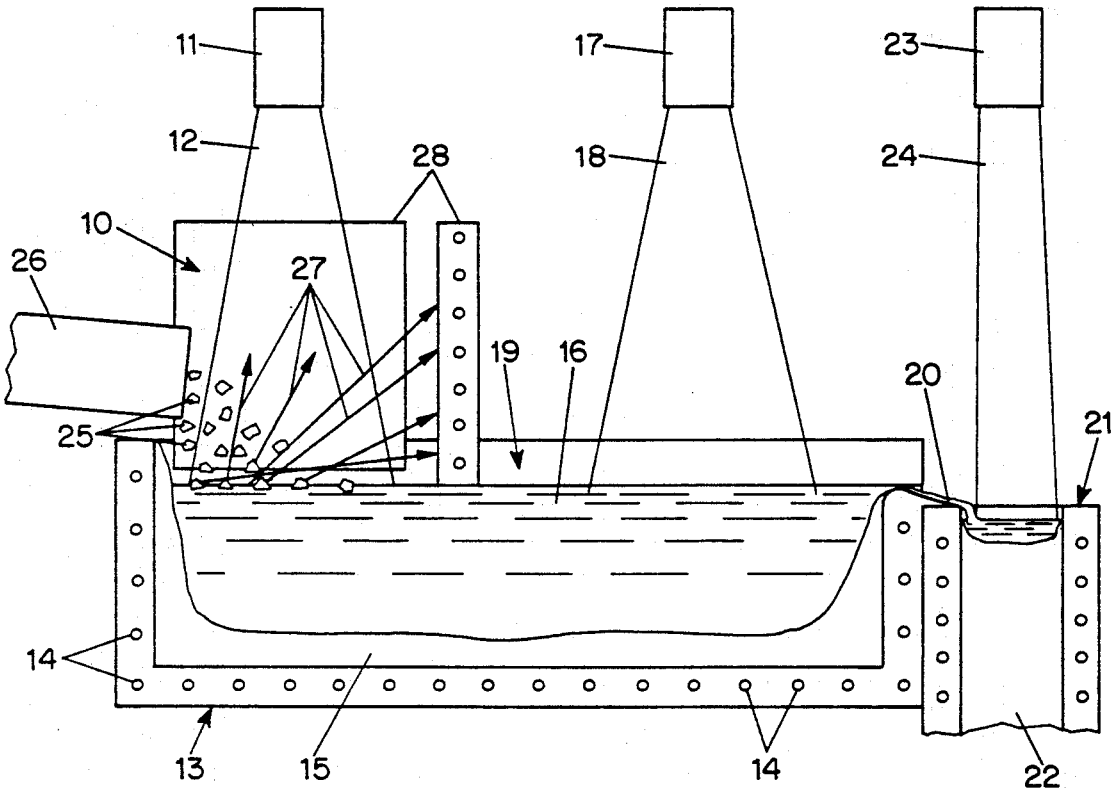
FIG. 1 is a schematic side view of a representative embodiment of a vacuum furnace arranged in accordance with the invention.
Figure 2:
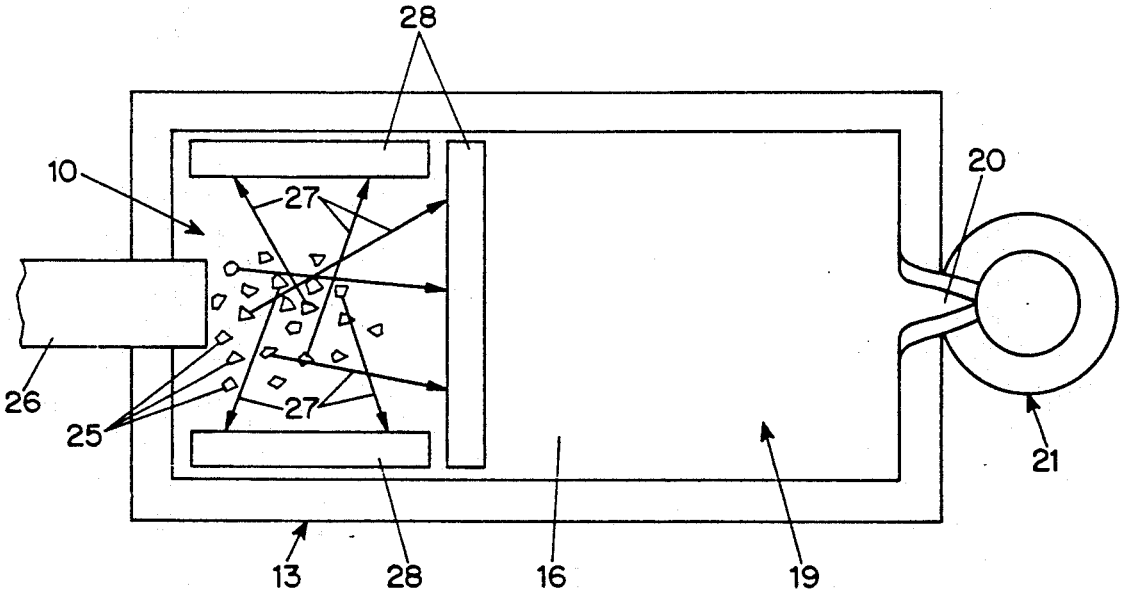
FIG. 2 is a schematic plan view of the furnace shown in FIG. 1.

In the representative embodiment of the invention shown in the drawings, the melting region 10 of a vacuum furnace, which may, for example, be an electron beam or plasma furnace having an evacuated enclosure (not shown) includes an electron beam or plasma gun 11 arranged in the usual manner to direct a beam of energy 12 in a controlled pattern to heat the metallic raw material to be melted and processed in the furnace. A hearth 13 arranged to receive the metallic material to be processed has circulation pipes 14 to circulate cooling water through the hearth in the usual manner. As a result, the hearth is lined with a solid skull 15 of the molten metal 16 in the hearth.

Another electron beam or plasma gun 17 is arranged to direct a beam of energy 18 in a controlled manner toward a refining region 19 at a location downstream in the hearth from the melting region 10 where the molten metal is refined and the concentration of constituents may be controlled by vaporization. After refining, the molten metal is transferred through a pour spout 20 into a water-cooled mold 21 where the refined metal is solidified into an ingot 22 and withdrawn downwardly in the usual manner. In order to control the solidification rate, another electron beam or plasma gun 23 directs a beam of energy 24 in a controlled manner toward the surface of the molten metal in the mold.

Solid metal such as titanium sponge which contains included vaporizable substances such as sodium or magnesium chloride as a result of the sponge formation process or compacted scrap metal containing vaporizable impurities is supplied in the form of solid pieces or particles 25 to the melting region 10 of the furnace through a feeding tube 26. The particles 25 may be carried through the feeding tube 26 by a screw conveyor or the like or they may be fed by gravity to the melting region.

The particles 25 may be supplied directly to the pool of molten metal 16, as shown in the drawings or, alternatively, the melting region of the hearth may have an elevated surface (not shown), disposed above the level of the molten metal 16, to which the particles 25 are supplied, thereby avoiding splashing of molten metal. In that case, the beam of energy 12 melts the particles to produce molten material which flows from the elevated surface into the pool of molten metal.

Impingement of energy from the gun 11 on the particles 25 initially melts the material at the surface of the particles. Because the particles contain vaporizable inclusions, heating of the particle surfaces causes the vaporizable material to be vaporized rapidly and to eject solid or partially melted metal away from the particles as indicated by the arrows 27. Such spraying of solid or partially melted material will occur regardless of whether the particles 25 are supplied directly to the pool of molten metal or are deposited on an elevated surface for melting. In addition, spraying of material from the melting region may be caused by splashing when the solid particles 25 are dropped into the molten metal 16. If such unrefined material is sprayed into the refining region 19, it may not be sufficiently refined before it is conveyed into the mold 21, resulting in contamination or compositional variation of the ingot 22 being formed in the mold.

In accordance with the invention, these problems are avoided by providing a series of shield members 28 substantially surrounding the melting region of the hearth to intercept material sprayed from the particles 25 as shown by the arrows 27 in the drawings. Most of the sprayed material thus intercepted falls back into the melting region 10 of the hearth. Any material which adheres to the shield surfaces may be melted by appropriate application of the energy beam 12 from the gun 11.

Preferably, each of the shield members 28 is provided with ducts for cooling water as illustrated in FIG. 1. Also, if desired, a further shield member may be included at the side where the feed tube 26 supplies material to the hearth. In this case, the feed tube 26 may be raised to a level above the upper edge of the shield or it may extend through an appropriate opening in the shield member.

Although the invention has been described herein with reference to specific embodiments, many modifications and variations therein will readily occur to those skilled in the art. Accordingly, all such variations and modifications are included within the intended scope of the invention.

We claim:

1. A method for vacuum processing of particulate metal containing vaporizble impurities in a hearth of a vacuum furnace comprising producing a vacuum in the furnace, supplying metal in particulate form to a melting region of the hearth where the particulate metal is melted by energy impingement, substantially surrounding the melting region of the hearth with shielding to intercept solid or partially melted metal sprayed from the melting region, and directing an energy beam toward the particulate metal in the melting region to melt the particulate metal.

2. A method according to claim 1 including passing molten metal from the melting region to a refining region and wherein the shielding surrounding the melting region prevents material sprayed from the melting region from reaching the refining region.

3. A method according to claim 1 including providing a plurality of closely-spaced shield members to substantially surround the melting region with shielding.

4. A method according to claim 1 including circulating coolant through the shielding.

5. A method according to claim 1 wherein the particulate metal is supplied to one side of the melting region through a feed tube and wherein the shielding includes a plurality of shield members enclosing the remainder of the melting region.

6. A vacuum furnace for processing particulate metal comprising hearth means having a melting region, vacuum means for producing a vacuum in the furnace, energy gun means disposed to direct a beam of energy toward the melting region, supply means for supplying metal in particulate form to the melting region, and shield means substantially surrounding the melting region to intercept material sprayed from the melting region.

7. A vacuum furnace according to claim 6 wherein the shield means comprises a plurality of shield members disposed adjacent to the melting region.

8. A vacuum furnace according to claim 6 wherein the shield means includes cooling means.

9. A vacuum furnace according to claim 6 wherein the supply means is disposed on one side of the melting region and the shield means includes a plurality of shield members enclosing the remainder of the melting region.

10. A vacuum furnace according to claim 6 wherein the hearth means includes a refining region to which molten metal flows from the melting region and the shield means prevents material from being sprayed into the refining region.

* * * * *